US006692415B1

(12) United States Patent
Winston

(10) Patent No.: US 6,692,415 B1
(45) Date of Patent: Feb. 17, 2004

(54) EXERCISE DEVICE AND KIT

(76) Inventor: Edith Winston, 2110 Harbourside Dr. #528, Longboat Key, FL (US) 34228

( * ) Notice: Subject to any disclaimer, the term of this patent is extended or adjusted under 35 U.S.C. 154(b) by 0 days.

(21) Appl. No.: 09/347,533

(22) Filed: Jul. 6, 1999

(51) Int. Cl.[7] ..... A63B 21/02
(52) U.S. Cl. ..... 482/126; 482/122; 482/124
(58) Field of Search ..... 482/121, 45, 50, 482/107, 46, 82, 122, 44, 106, 108, 126, 49, 93, 124

(56) References Cited

U.S. PATENT DOCUMENTS

| | | | |
|---|---|---|---|
| 163,957 A | | 6/1875 | Wood |
| 512,483 A | | 1/1894 | Patterson |
| 2,719,038 A | | 9/1955 | Massa |
| 2,930,614 A | | 3/1960 | McIntosh |
| 3,460,829 A | | 8/1969 | Roggero |
| 3,655,185 A | | 4/1972 | Kane |
| 4,079,932 A | | 3/1978 | Schuetz |
| 4,673,179 A | | 6/1987 | Pengler |
| 4,685,671 A | | 8/1987 | Hagerman et al. |
| 4,722,523 A | | 2/1988 | Yang |
| 4,779,867 A | | 10/1988 | Hinds |
| 4,787,624 A | | 11/1988 | Grant |
| 4,801,137 A | | 1/1989 | Douglass |
| 4,852,873 A | | 8/1989 | O'Donnell et al. |
| 5,033,740 A | | 7/1991 | Schwartz et al. |
| 5,052,365 A | | 10/1991 | Carella |
| 5,131,650 A | | 7/1992 | Hall |
| 5,244,444 A | | 9/1993 | Wostry |
| 5,314,396 A | | 5/1994 | Parr |
| 5,336,151 A | | 8/1994 | Van Ballegooie |
| 5,514,058 A | | 5/1996 | Buoni et al. |
| 5,549,532 A | * | 8/1996 | Kropp |
| 5,569,137 A | | 10/1996 | Uen |
| 5,613,926 A | | 3/1997 | Michaelson |
| 5,620,397 A | | 4/1997 | Chieh |
| 5,637,066 A | | 6/1997 | Chang |
| 5,741,207 A | | 4/1998 | Buoni et al. |
| 5,800,322 A | | 9/1998 | Block |
| 5,873,805 A | | 2/1999 | Ayres et al. |

OTHER PUBLICATIONS

Super Circuit.
Tension Exercise Device.
Accessory Pulley.
Thera–Band.
Standing Exercise System.
Sitting Exercise System.

* cited by examiner

*Primary Examiner*—Nicholas D. Lucchesi
*Assistant Examiner*—Lalita M. Hamilton
(74) *Attorney, Agent, or Firm*—Edell, Shapiro & Finnan LLC

(57) ABSTRACT

A handle for use with an elastomeric tube in a resistance exercise device is generally U-shaped with a grip removably secured between opposite ends of the handle. A frusto-conical throat is defined through the nadir of the U-shape and receives one end of the tube. A retainer ball of greater diameter than the tube is inserted into one diametrically stretched end of the tube. The diameter of the retainer ball is smaller than the large diameter proximal end of the throat but greater than the small diameter distal end of the throat. With the end of the tube stretched about the retainer ball, the ball compresses the tube wall against the frusto-conical throat wall with a force that increases as the tension in the tube increases (i.e., as the tube is pulled distally). As a result, the tube is prevented from becoming loose and becoming disengaged from the handle during use. Alternatively, a collar may be disposed about the tube distally of the retainer ball to prevent the retainer ball and surrounding tube portion from distally traversing the throat, thereby securing the tube to the handle. In yet another manner, the throat may include various configurations to provide a fitted engagement with the retainer ball and surrounding tube portions. The handle structure is preferably sold as part of a kit, and can be modified so that a second weighted bar, parallel to the weighted grip, can be removably connected between the arms of the U-shaped handle.

25 Claims, 4 Drawing Sheets

EXERCISE DEVICE AND KIT

BACKGROUND OF THE INVENTION

1. Technical Field

The present invention pertains to exercise equipment of the type including an elastic band or tube having handles at its ends. More particularly, the present invention relates to an improved handle structure, and to a combination of interrelated components of exercise equipment sold in kit form.

2. Discussion of the Prior Art

Resistance exercise devices comprising an elastomeric band or tube secured between two handles are well known. Examples of such devices may be found in U.S. Pat. No. 2,930,614 (McIntosh), U.S. Pat. No. 3,655,185 (Kane), U.S. Pat. No. 4,779,867 (Hinds), U.S. Pat. No. 5,131,650 (Hall), U.S. Pat. No. 5,620,397 (Chieh) and U.S. Pat. No. 5,800,322 (Block). In using these devices, the handles are typically grasped in a manner whereby the elastomeric band is alternately stretched and released between the handles such that the tension created in the band exercises the muscles of the user.

A recognized problem associated with equipment of this type is the inadvertent separation of the elastomeric band from the handles, particularly while the band is in tension. Such separation can result in the band snapping back to its relaxed or untensioned state and possibly causing injury to the user. The problem associated with securely connecting the band to the handles is exacerbated in situations where the band is to be replaced by the user. Specifically, if the band is to be replaced, a less than permanent connection is required. Typically, such a connection can come apart at undesirable times.

Another disadvantage associated with prior art equipment of the type described is that all of the muscle exercise benefit relates solely to the resistance of the particular band. Stated otherwise, prior art handles are generally made of lightweight material and, of themselves, impart no benefit to the exercise process. It would be desirable to have a handle that could be weighted in a manner so as to enhance, rather than detract from, the exercises performed with the device.

Prior art devices of the type described are purchased as a unit with a single elastomeric band or tube of fixed tensile resistance. As the strength of a user increases, it is desirable to have additional bands or tubes of greater tensile resistance to thereby permit continued increase of muscle strength and tone.

OBJECTS AND SUMMARY OF THE INVENTION

Accordingly, it is an object of the present invention to provide an improved handle and connecting structure in a resistance exerciser of the type employing an elastomeric tube in order to prevent inadvertent dissociation of the elastomeric tube from the handle.

It is another object of the present invention to provide an improved handle and connecting structure in a resistance exerciser of the type employing an elastomeric tube, whereby elastomeric tubes of different tensile resistance can be easily interchanged without sacrificing the security of the connection of the tube to the handle when the device is in use.

Yet another object of the present invention is to provide a unique handle structure in an exercise device of the type described such that the handle can be selectively weighted.

Still another object of the present invention is to provide an exercise kit with multiple components including interchangeable elastomeric bands of different tensile resistance and handles with interchangeable weights.

The aforesaid objects are achieved individually and in combination, and it is not intended that the present invention be construed as requiring two or more of the objects to be combined unless expressly required by the claims attached hereto.

In accordance with the present invention, a handle for use with an elastomeric tube in a resistance exercise device is generally U-shaped with a grip removably secured by screws or the like between opposite ends of the handle. The grip is in the form of a cylindrical bar of known weight having a plastic foam cover. A frusto-conical throat is defined through the nadir of the U-shape and receives one end of an elastomeric tube. The wider diameter proximal end of the throat faces interiorly of the U-shaped handle (i.e., toward the grip). In the preferred embodiment, a solid retainer ball of greater diameter than the elastomeric tube is inserted into one diametrically stretched end of the elastomeric tube. The diameter of the retainer ball is smaller than the large diameter proximal end of the throat but greater than the small diameter distal end of the throat. With the end of the elastomeric tube diametrically stretched about the retainer ball, the ball compresses the tube wall against the frusto-conical throat wall with a force that increases as the tension in the tube increases (i.e., as the tube is pulled distally). As a result, the tube is prevented from becoming loose and becoming disengaged from the handle during use.

The elastomeric tube can be easily replaced with tubes of different tensile resistance by simply pushing the tube and the retainer ball proximally through the throat (i.e., inwardly of the handle) until the ball is free of the throat. The retainer ball can then be removed from the stretched tube end, and the original tube can be withdrawn distally from the throat. A new tube may then be inserted proximally through the throat and its end stretched diametrically to receive the retainer ball. The retainer ball and surrounding tube are then pulled distally into the throat to hold the newly inserted tube in place relative to the handle.

Alternatively, a collar may be disposed about the tube end with the retainer ball inserted into the tube as described above proximally of the collar. The collar diameter is less than the diameter of the retainer ball, whereby the collar and stretched tube portion containing the retainer ball are positioned in the throat with the retainer ball and surrounding tube portion partially disposed within the collar. The collar prevents the retainer ball and surrounding tube portion from distally traversing the throat, thereby securing the tube to the handle. The tube may be replaced by removing the collar and retainer ball from the tube, withdrawing the tube from the throat, and securing a new tube to the handle as described above.

In yet another manner of removably connecting the tube to the handle, the throat may include various configurations to provide a fitted engagement with the retainer ball and surrounding tube portions. In particular, the throat may be generally cylindrical having a larger diameter proximal portion relative to the diameter of a throat distal portion to thereby form a pocket or receptacle at the throat proximal end for fitted engagement with the retainer ball and surrounding tube portions. The retainer ball has a diameter greater than the individual diameters of the tube and throat distal portion but less than the enlarged diameter of the throat proximal portion, and is inserted into the tube as described above. The retainer ball and surrounding tube portions are disposed within the pocket with the retainer ball compressing the surrounding tube walls against a substantial portion of the pocket wall with a force that increases as the tension in the tube increases (i.e., as the tube is pulled distally). As a result, the tube is prevented from becoming loose or becoming disengaged from the handle. The tube may be replaced by removing the retainer ball from the tube, withdrawing the tube from the throat, and securing a new tube to the handle as described above. Alternatively, the pocket may be formed as described above within an intermediate throat portion with the larger diameter proximal portion extending from the pocket to the throat proximal end to provide the retainer ball and surrounding tube portions with access to the pocket. The pocket removably secures the tube to the handle and may be replaced with a new tube in substantially the same manner described above.

The handle structure is preferably sold as part of a kit including two handles (i.e., one for each end of the tube), a plurality of elastomeric tubes of different tensile resistance, two retainer balls (i.e., one for each handle) and a plurality (e.g., two, four, six, etc.) of additional grip bars having different weights.

The handle structure can be modified so that a second weighted bar, parallel to the weighted grip, can be removably connected between the arms of the U-shaped handle.

The above and still further objects, features and advantages of the present invention will become apparent upon consideration of the following detailed description of specific embodiments thereof, particularly when taken in conjunction with the accompanying drawings wherein like reference numerals in the various figures are utilized to designate like components.

DETAILED DESCRIPTION OF THE PREFERRED EMBODIMENTS

Figure 1:
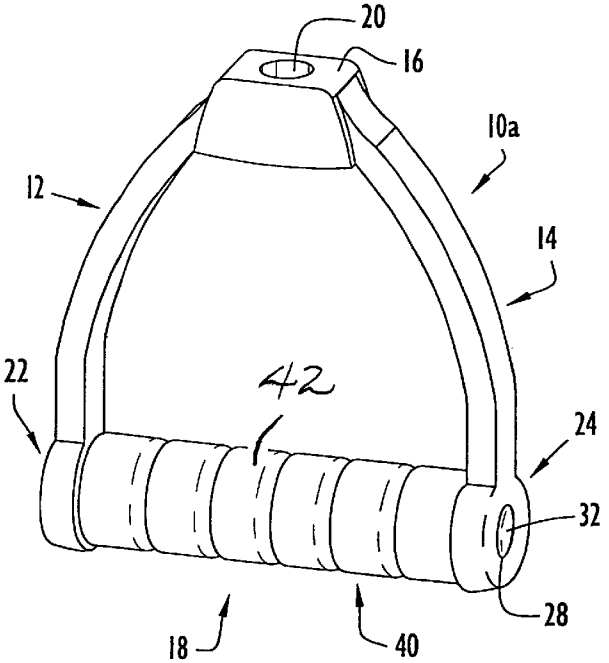
FIG. 1 is a view in perspective of a handle for an exercise device according to the present invention.
Figure 2:
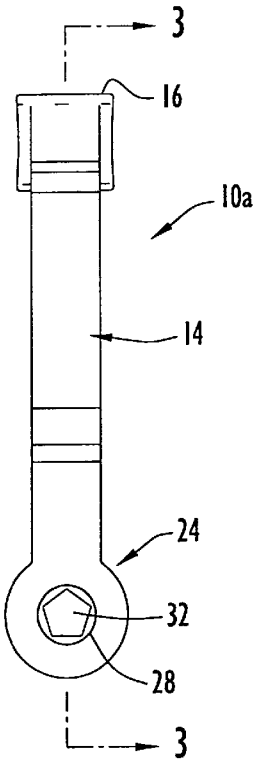
FIG. 2 is a side view in elevation of the handle of FIG. 1.
Figure 3:
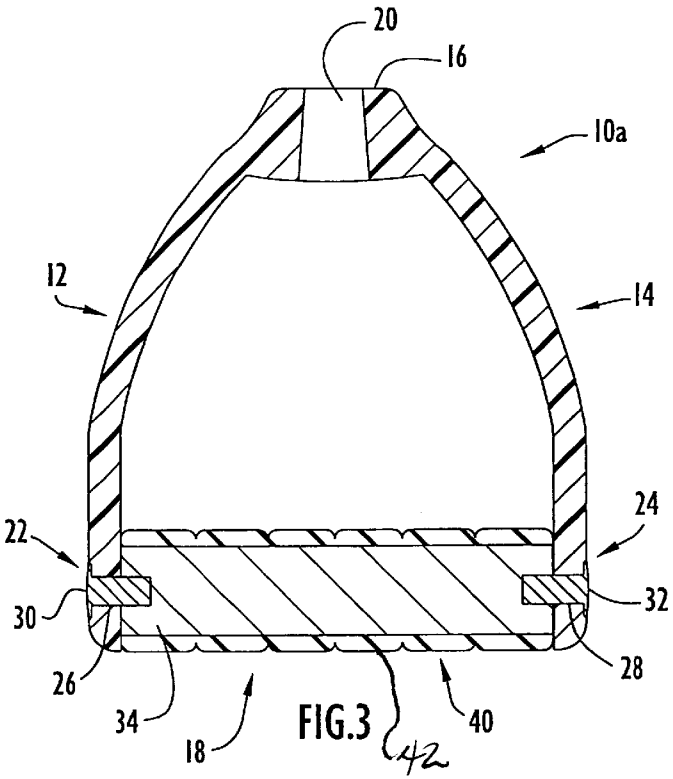
FIG. 3 is a view in section taken along lines 3—3 of FIG. 2.

The present invention pertains to an improved handle and connecting structure for an exercise device of the type utilizing elastomeric bands or tubes to provide resistance for exercising various muscles. The exercise device of the present invention comprises two such handles interconnected by an elastomeric band, whereby the band is connected to each handle via a corresponding connecting structure. The exercise device is typically utilized by grasping the handles in a manner whereby the elastomeric band is alternately stretched and released between the handles such that the tension created in the band exercises the muscles of a user. The handles and connecting structure enable the band to be replaced by other bands of various tensile resistances or strengths to adjust the resistance provided by the exercise device. A handle according to the present invention is illustrated in FIGS. 1–3. Specifically, handle 10*a* is generally stirrup shaped (i.e., generally U-shaped) and includes arms 12, 14, a base 16 and a grip 18. Arm 12 is preferably of rectangular transverse cross-section and constructed of high impact plastic. The arm includes a tapered distal end and a grip interface 22 disposed at the arm proximal end. A slight inward bend is formed in arm 12 distally of grip interface 22, whereafter the arm curves inwardly from the bend toward the handle interior. Grip interface 22 is generally annular having a substantially central recessed opening or hole 26 defined therein. The opening is recessed within arm 12 to accommodate a fastener for securing grip 18 to the handle as described below.

Arm 14 is substantially a mirror image of arm 12 and includes a tapered distal end and a grip interface 24 disposed at its proximal end, and a slight bend is formed distally of grip interface 24, whereafter the arm curves inwardly from the bend toward the handle interior. Grip interface 24 is substantially similar to grip interface 22 and includes a generally annular configuration with a substantially central recessed opening 28 defined therein for accommodating a fastener to secure grip 18 to the handle as described above.

Arms 12, 14 are positioned in facing relation with grip interfaces 22, 24 substantially aligned. The arms curve inwardly from their respective bends toward the handle interior with the tapered distal ends of the arms joined to base 16. Base 16 generally serves as a handle neck and is in the form of a generally trapezoidal block. The base includes a substantially central frusto-conical throat or channel 20 defined therein having a larger diameter at the throat proximal end (e.g., the throat end facing interiorly of the U-shaped handle). The throat receives one end of an elastomeric band to facilitate removable connection of the band to the handle as described below.

Grip 18 is secured to and extends between grip interfaces 22, 24. The grip includes a generally cylindrical bar 34 and a cushioned finger grip cover 40 that is disposed over and encloses the bar. Bar 34 is typically of known weight having tapped holes (not shown) recessed centrally and axially of its opposite ends. The tapped holes are aligned with corresponding recessed grip interface openings 26, 28 to permit screws 30, 32 to be inserted through the respective openings and tapped holes to secure the grip to the handle. The grip interface openings are recessed to essentially form respective notches within the arms for enabling heads of screws 30, 32 to be substantially flush with the exterior surfaces of the arms when securing the grip to the handle. Cover 40 is typically constructed of plastic foam and includes a series of ribbed sections 42 to enhance gripping efficiency and user comfort during exercise.

By way of example only: handle 10*a* may have a length (e.g., the distance from the throat distal end to the proximal ends of the arms) of approximately fifteen centimeters and a proximal width dimension (e.g., the distance between the exterior surfaces of the arms at their proximal ends) of approximately fourteen centimeters; base 16 may have a proximal width dimension (e.g., the distance along the base proximal end between the tapered distal ends of the arms) of approximately 4.4 centimeters, a distal width dimension (e.g., the distance along the base distal end between the tapered distal ends of the arms) of approximately 3.5 centimeters, and a length (e.g., the distance between the base proximal and distal ends) of approximately 2.6 centimeters and a depth of approximately 2.7 centimeters; the throat may have a proximal end diameter of approximately two centimeters and a distal end diameter of approximately 1.5 centimeters; and the grip may have a length (e.g., the distance along a longitudinal axis of the grip) of approximately twelve centimeters with an approximate cross-sectional diameter of 3.4 centimeters (e.g., the diameter of grip 18 with covering 40, whereby the cross-sectional diameter of individual grip bar 34 without the covering is approximately 2.5 centimeters). However, the handle, base and grip (e.g., including the grip bar) may be of any size or shape, and may be constructed of any suitable materials.

The resistance provided by the exercise device may be adjusted by interchanging bands of various tensile strengths. The relative tensile strength of a band constructed of a particular material is generally related to the band diameter, whereby the greater the band diameter, the greater the resistance provided by that band relative to other bands of the same material. The bands may be constructed of rubber, latex, steel (e.g., the band may be implemented by a cable), woven steel, rope or other suitable materials, and are removably connected to the handle to facilitate band interchange. This interchange feature enables the handles to provide protection for a user allergic to latex or other types of bands, since the user may interchange that band with another band compatible with the user.

Figure 4:
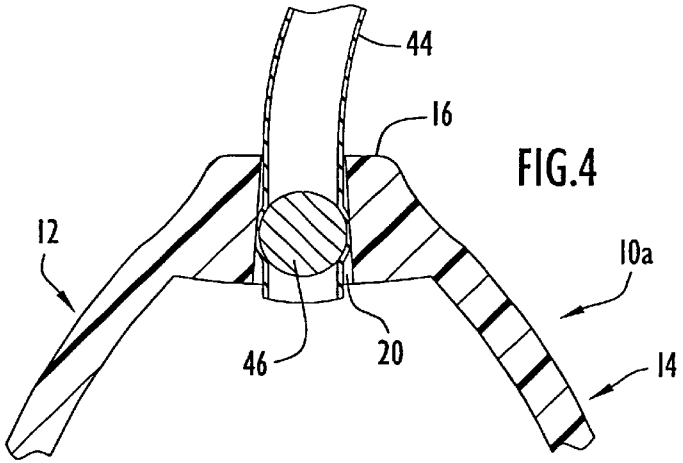
FIG. 4 is a detailed view in section of the throat portion of the handle of FIG. 1 showing one manner of securing an elastomeric band to the handle.

A manner of removably connecting a band to handle 10*a* is illustrated in FIG. 4. Specifically, one end of a band 44 is inserted proximally through throat 20 and extends slightly into the handle interior. Band 44 is preferably implemented by an elastomeric tube having a diameter less than the individual diameters of the throat proximal and distal ends. The band end extending into the handle interior is diametrically stretched to receive a solid retainer ball 46 having a diameter greater than the individual diameters of the band and throat distal end but less than the diameter of the throat proximal end. The retainer ball is typically positioned within the band a slight distance from the band receiving end, whereby the surrounding band portion stretches about the ball to secure the ball within the band. The band is subsequently pulled distally through throat 20 to position retainer ball 46 and the surrounding stretched band portion within the throat toward an intermediate throat position having a diameter slightly less than the diameter of the stretched band portion containing the retainer ball. The physical dimensions of the intermediate throat position prevent the retainer ball and stretched tube portion from further distally traversing the throat, in that the retainer ball compresses the surrounding band walls against the frusto-conical throat walls with a force that increases as the band tension increases (e.g., as the band is pulled distally through the throat or forced distally through the throat from band tension created during use of the exercise device). The retainer ball thus prevents the band from becoming loose or becoming disengaged from the handle, particularly during use.

Band 44 may be removed from the handle and replaced with bands of different tensile strengths to alter the resistance of the exercise device. In particular, band 44 is pushed proximally through throat 20 until the stretched band portion containing retainer ball 46 is free of the throat. The retainer ball is removed from the stretched band portion and the band is subsequently withdrawn from the throat. A new band having a different tensile strength may be inserted proximally through throat 20 with an end extending slightly beyond the throat proximal end into the handle interior. The new band end is diametrically stretched for insertion of retainer ball 46 into the band, whereby the new band is pulled distally through throat 20 to position the stretched band portion containing retainer ball 46 within the throat. The retainer ball secures the new band to the handle as described above.

Figure 5:
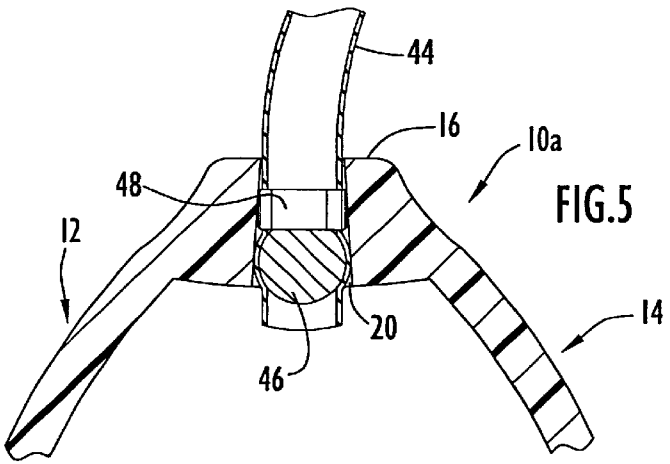
FIG. 5 is a detailed view in section of the throat portion of the handle of FIG. 1 showing an alternative manner of securing an elastomeric band to the handle.

An alternative manner of removably connecting band 44 to handle 10*a* is illustrated in FIG. 5. This manner is similar to the technique described above for FIG. 4 except that a collar is utilized to reinforce the stretched band portion containing the retainer ball within throat 20. Specifically, one end of band 44 is inserted proximally through throat 20 and extends slightly into the handle interior. A collar 48 is disposed about that band end and has a diameter slightly greater than the individual diameters of the band and throat distal end but less than the individual diameters of retainer ball 46 and the throat proximal end. The band end extending into the handle interior is diametrically stretched to receive retainer ball 46. The retainer ball is typically positioned within the band a slight distance from the band receiving end, whereby the surrounding band portion stretches about the ball to secure the ball within the band. The band is pulled distally through throat 20 to position the collar within the throat at an intermediate throat position having a diameter less than the diameter of the collar. The physical dimensions of that intermediate throat position prevent the collar from further distally traversing the throat. The distal motion of band 44 further causes the stretched band portion containing the retainer ball to slide relative to the collar, thereby partially disposing retainer ball 46 and the surrounding band portion within the collar. The collar essentially serves as a stop for the retainer ball, whereby the physical dimensions of the collar prevent the stretched band portion containing the retainer ball from further distally traversing the throat. The retainer ball compresses a portion of the surrounding band walls against the collar with a force that increases as the band tension increases (e.g., as the band is pulled distally through the throat or forced distally through the throat from band tension created during use of the exercise device). The retainer ball and collar thus prevent the band from becoming loose or becoming disengaged from the handle.

Band 44 may be removed from the handle and replaced with bands of different tensile strengths to alter the resistance of the exercise device in a similar manner as described above. In particular, band 44 is pushed proximally through throat 20 until collar 48 and the stretched band portion containing retainer ball 46 are free of the throat. The retainer ball and collar are removed from the band, and the band is subsequently withdrawn from the throat. A new band having a different tensile strength may be inserted proximally through throat 20 with an end extending slightly beyond the throat proximal end into the handle interior. Collar 48 is placed over the new band end, and that end is diametrically stretched for insertion of retainer ball 46 within the band proximally of the collar as described above. The new band is pulled distally through throat 20 to position the collar and stretched band portion containing the retainer ball within the throat to secure the new band to the handle as described above.

Alternatively, a ring, preferably constructed of steel or other suitable material, may be utilized in place of collar 48 to secure band 44 to the handle. In particular, the ring includes a diameter substantially similar to the collar diameter and is disposed about a band end inserted proximally through the throat and extending slightly into the handle interior. The band end is diametrically stretched for insertion of retainer ball 46 into the band as described above proximally of the ring. The band is pulled distally through the throat, whereby the ring becomes positioned within the throat toward an intermediate throat portion having a diameter less than the ring diameter. The ring essentially serves as a stop for the retainer ball, whereby the physical dimensions of the ring prevent the stretched band portion containing the retainer ball from further distally traversing the throat, thereby securing the band to the handle.

The ring and retainer ball may alternatively have diameters greater than the diameter of the throat proximal end, whereby the ring diameter is less than the diameter of the retainer ball. Specifically, the ring is disposed about the band end as described above, while the band end is diametrically stretched for insertion of retainer ball 46 into the band proximally of the ring as described above. The band is pulled distally through the throat, whereby the ring is positioned proximate the throat proximal end to prevent the stretched band portion containing the retainer ball from entering and traversing the throat, thereby securing the band to the handle. The band may be replaced in the ring embodiments in substantially the same manner described above for the collar by removing the ring and retainer ball from the band, withdrawing the band from the throat and inserting a new band through the throat to receive the ring and retainer ball for securing that band to the handle as described above.

Figure 6:
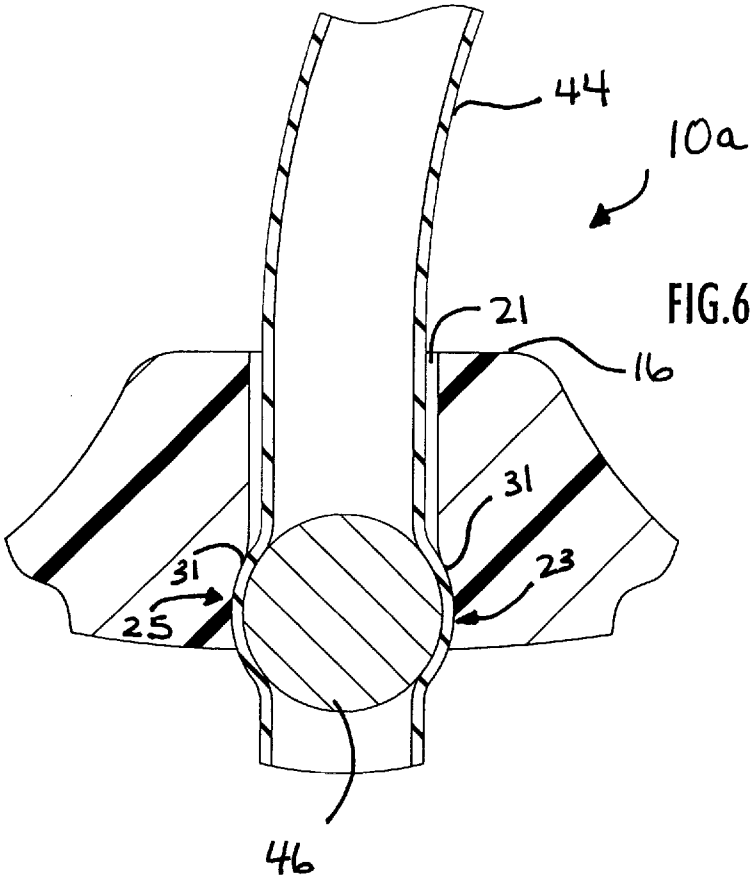
FIG. 6 is a detailed view in section of a modified throat portion for the handle of FIG. 1 showing yet another manner of securing an elastomeric band to the handle.

Yet another manner of removably connecting a band to handle 10*a* is illustrated in FIG. 6. This manner is similar to the technique described above for FIG. 4 except that the throat is configured for a fitted engagement with retainer ball 46 and the surrounding band portions. Specifically, base 16 includes a throat 21 substantially centrally defined therein for receiving band 44. Throat 21 is similar to throat 20 described above, but is configured for a fitted engagement with retainer ball 46 and the surrounding band portions. In particular, throat 21 is generally cylindrical having a proximal portion 25 of larger diameter relative to the diameter of the throat distal portion, thereby defining a pocket or receptacle 23 at the throat proximal end for receiving the retainer ball and surrounding band portions. The retainer ball has a diameter greater than the individual diameters of the band and throat distal portion, but slightly less than the enlarged diameter of the throat receptacle. Proximal portion 25 curves outwardly of the throat and generally follows the contour of retainer ball 46 to form pocket 23. Basically, the pocket is in the form of a spherical segment configured to receive a portion of the retainer ball and surrounding band portions. The pocket configuration provides greater surface contact between the surrounding band portions and the throat and increases the frictional forces therebetween, thereby enhancing the security of the connection. In addition, the greater surface contact distributes stress within an increased band area to reduce concentrated band wear at particular locations.

A shoulder 31 is defined at the junction where the throat proximal and distal portions meet, and generally includes a smooth, rounded configuration for transition between the throat proximal and distal portions. The shoulder basically serves as a stop to prevent the retainer ball and surrounding band portions from distally traversing the throat, while the smooth, rounded shoulder configuration hinders band wear from forces applied by the retainer ball to the band as described below.

One end of band 44 is inserted proximally through throat 21 and extends slightly into the handle interior. Band 44 has a diameter less than the individual diameters of the throat proximal and distal ends. The band end extending into the handle interior is diametrically stretched to receive retainer ball 46 as described above. The retainer ball is typically positioned within the band a slight distance from the band receiving end, whereby the surrounding band portion stretches about the ball to secure the ball within the band. The band is subsequently pulled distally through throat 21 to position retainer ball 46 and the surrounding stretched band portion partially within pocket 23 proximate shoulder 31 with the remaining ball and band portions extending slightly beyond the throat distal end into the handle interior. The physical dimensions of the shoulder and throat distal portion prevent the retainer ball and stretched band portion from further distally traversing the throat, in that the retainer ball compresses the surrounding band walls against shoulder 31 and a substantial portion of the pocket wall with a force that increases as the band tension increases (e.g., as the band is pulled distally through the throat or forced distally through the throat from band tension created during use of the exercise device). The pocket provides a fitted engagement for the retainer ball, and hence, a greater area of surface contact between the surrounding band portions and the throat as described above, thus preventing the band from becoming loose or becoming disengaged from the handle, particularly during use. In addition, the smooth, rounded shoulder configuration prolongs band life since the band is not compressed against any sharp edges by the retainer ball.

Band 44 may be removed from the handle and replaced with bands of different tensile strengths to alter the resistance of the exercise device in a similar manner as described above. In particular, band 44 is pushed proximally through throat 21 until the stretched band portion containing retainer ball 46 is free of the throat. The retainer ball is removed from the stretched band portion and the band is subsequently withdrawn from the throat. A new band having a different tensile strength may be inserted proximally through throat 21 with an end extending slightly beyond the throat proximal end into the handle interior. The new band end is diametrically stretched for insertion of retainer ball 46 into the band, whereby the new band is pulled distally through throat 21 to position the stretched band portion containing retainer ball 46 within pocket 23. The retainer ball secures the new band to the handle as described above.

Figure 7:
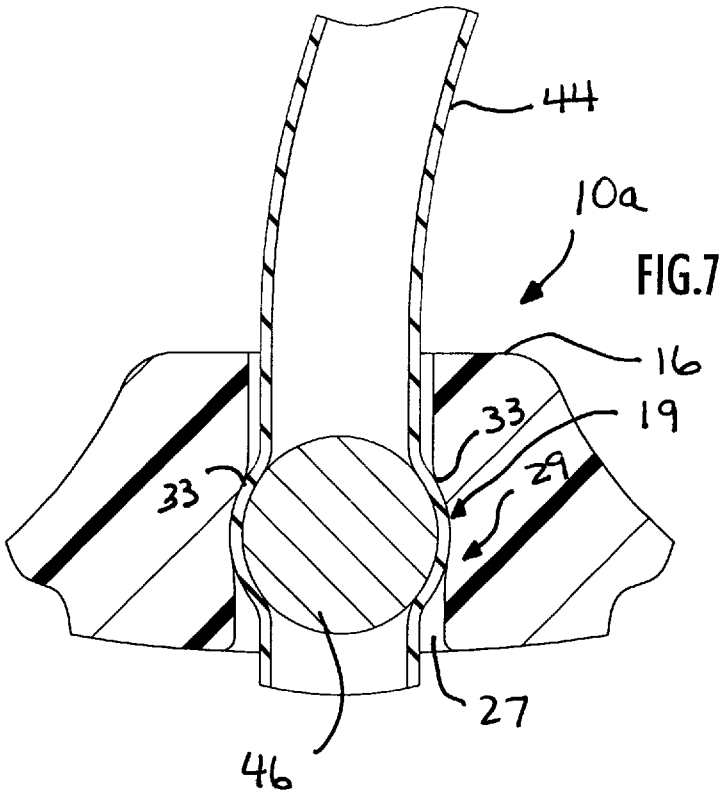
FIG. 7 is a detailed view in section of yet another modified throat portion for the handle of FIG. 1 showing a further manner of securing an elastomeric band to the handle.

Still another manner of removably connecting a band to handle 10*a* is illustrated in FIG. 7. This manner is substantially similar to the technique described above for FIG. 6 except that the throat pocket is formed at an intermediate throat position. Specifically, base 16 includes a throat 27 substantially centrally defined therein for receiving band 44. Throat 27 is similar to throat 21 described above, but includes a pocket 19, similar to pocket 23, defined at an intermediate throat position for fitted engagement with retainer ball 46 and the surrounding band portions. In particular, throat 27 is generally cylindrical having a proximal portion 29 of larger diameter relative to the diameter of the throat distal portion, thereby defining pocket or receptacle 19 at a throat intermediate position to receive the retainer ball and surrounding band portions. The retainer ball has a diameter greater than the individual diameters of the band and throat distal portion, but slightly less than the enlarged diameter of pocket 19. Proximal portion 29 curves outwardly of the throat at the intermediate throat position and generally follows the contour of retainer ball 46 to define pocket 19. Basically, pocket 19 is in the form of a spherical segment configured to receive a portion of the retainer ball and surrounding band portions. The pocket configuration provides greater surface contact between the surrounding band portions and the throat to increase the frictional forces therebetween and distribute stress within an increased band area as described above. Proximal portion 29 further extends from pocket 19 to the throat proximal end to provide the retainer ball and surrounding band portions with access to pocket 19.

A shoulder 33, substantially similar to shoulder 31 described above, is defined at the junction where the throat proximal and distal portions meet, and generally includes a smooth, rounded configuration for transition between the proximal and distal portions of the throat. The shoulder basically serves as a stop to prevent the retainer ball and surrounding band portions from distally traversing the throat, while the smooth, rounded shoulder configuration hinders band wear from forces applied by the retainer ball to the band as described above.

One end of band 44 is inserted proximally through throat 27 and extends slightly into the handle interior. Band 44 has a diameter less than the individual diameters of the throat proximal and distal ends. The band end extending into the handle interior is diametrically stretched to receive retainer ball 46 as described above. The retainer ball is typically positioned within the band a slight distance from the band receiving end, whereby the surrounding band portion stretches about the ball to secure the ball within the band. The band is subsequently pulled distally through throat 27 to position retainer ball 46 and the surrounding stretched band portion in pocket 19 proximate shoulder 33. The physical dimensions of the shoulder and throat distal portion prevent the retainer ball and stretched band portion from further distally traversing the throat, in that the retainer ball compresses the surrounding band walls against shoulder 33 and a substantial portion of the pocket wall with a force that increases as the band tension increases (e.g., as the band is pulled distally through the throat or forced distally through the throat from band tension created during use of the exercise device). Pocket 19 provides a fitted engagement for the retainer ball, and hence, a greater area of surface contact between the surrounding band port ions and the throat as described above, thus preventing the band from becoming loose or becoming disengaged from the handle, particularly during use. In addition, the smooth, rounded shoulder configuration prolongs band life since the band is not compressed against any sharp edges as described above.

Band 44 may be removed from the handle and replaced with bands of different tensile strengths to alter the resistance of the exercise device. In particular, band 44 is pushed proximally through throat 27 until the stretched band portion containing retainer ball 46 is free of the throat. The retainer ball is removed from the stretched band portion and the band is subsequently withdrawn from the throat. A new band having a different tensile strength may be inserted proximally through throat 27 with an end extending slightly beyond the throat proximal end into the handle interior. The new band end is diametrically stretched for insertion of retainer ball 46 into the band, whereby the new band is pulled distally through throat 27 to position the stretched band portion containing retainer ball 46 within pocket 19. The retainer ball secures the new band to the handle as described above.

It is to be understood that various conventional or other techniques may be employed to removably connect the band to the handle. For example, the band may be removably connected to the handle via an adjustable screw. The screw includes a threaded hollow body and a ball-shaped head having a diameter greater than the diameter of the throat proximal end. A substantially central channel is defined through the head and aligned with the screw body to form a passage for receiving the band. The throat may be defined to include any suitable shape, and has a threaded interior for engagement with the screw body, whereby the screw body is dimensioned to extend through the throat with the screw head disposed proximate the throat proximal end. One end of the band is inserted proximally through the passage and extends slightly beyond the head into the handle interior. A clip is disposed on the band end extending into the handle interior to prevent the band from becoming disengaged from the screw. The band end may be clipped directly to the screw head, or the clip may include dimensions greater than the dimensions of the passage, thereby preventing the clip, and hence, the band from traversing the passage. A locking mechanism (e.g., a locknut, set screw, etc.) is disposed proximate the throat proximal end to secure the screw within the throat and prevent the screw from turning and becoming dislodged from the throat threads. The screw is preferably constructed of heavy impact plastic, but may be constructed of other suitable materials. As band tension forces the band distally through the throat during use of the exercise device, the physical dimensions of the screw head and/or clip prevent the screw head and/or clip, and hence, the band from traversing the throat, while the locking mechanism ensures that the screw is engaged with the throat, thereby securing the band to the handle. The band may be replaced by unclipping the band from the screw head, withdrawing that band from the throat and inserting a new band through the screw for clipping to the screw head as described above.

Another manner of removably connecting the band to the handle may include a ball-shaped cord lock having openings for permitting the band to traverse the lock. The lock generally includes springs that apply frictional force to band portions traversing the lock to prevent the lock from sliding along the band. The throat may be defined to include any suitable shape, while the lock includes a diameter larger than the diameter of the throat proximal end. The lock is fastened to a band end inserted proximally through the throat and extending slightly into the handle interior. As band tension forces the band distally through the throat during use of the exercise device, the physical dimensions of the lock prevent the lock, and hence, the band from being pulled through the throat, thereby securing the band to the handle. The band may be replaced by removing the lock from the band and withdrawing the band from the throat. A new band is then inserted proximally through the throat and the lock is attached to an end of the new band to secure the new band to the handle as described above.

Yet another manner of removably connecting the band to the handle utilizes a hollow tube having a ball attached to its proximal end. The throat may be defined to include any suitable shape, while the ball includes a diameter greater than the diameter of the throat proximal end. The tube is dimensioned for placement within the throat, while the ball includes a substantially centrally defined channel aligned with the hollow tube to form a passage for receiving the band. The hollow tube distal end extends beyond the throat distal end and includes threads to engage a threaded nut to secure the hollow tube within the throat. An end of the band is inserted proximally through the passage and slightly extends into the handle interior. A clip is disposed on that band end to prevent the band from sliding through the throat and becoming disengaged from the handle. The band end may be clipped directly to the ball, or the clip may include dimensions greater than the dimensions of the passage, thereby preventing the clip, and hence, the band from traversing the passage. As band tension forces the band distally through the throat during use of the exercise device, the physical dimensions of the ball and/or clip prevent the ball and/or clip, and hence, the band from traversing the throat, thereby securing the band to the handle. The hollow tube and ball are typically constructed of plastic, but may be constructed of any suitable materials. The band may be replaced by unclipping the band from the ball and withdrawing the band from the passage. A new band is then inserted proximally into the passage and is clipped to the ball as described above. The ball and hollow tube secure the new band to the handle in substantially the same manner described above.

Exercise device resistance may additionally be adjusted by altering the weight of the handle. Additional handle weight increases resistance and adds workload to muscles to firm, tone and enhance muscle bulk and strength. Since exercise device resistance is partially dependent upon the bands which have minimal weight, increased handle weight enables the handles to impact and enhance the workout. Referring back to FIGS. 1–3, handle 10*a* is typically constructed to weigh approximately one pound, but may alternatively be constructed of steel or other heavy materials to provide additional handle weight. Handle, 10*a* may be utilized with various weighted grips 18 for adjustment of handle weight to provide a desired resistance for exercise. In particular, grip bar 34 may be constructed to have various weights, whereby handle 10*a* may be utilized with a series of grips 18 each having a grip bar 34 of different weight. The grips are interchanged in order to provide the handle with a desired weight for exercise. The grip interchange is accomplished by simply removing screws 30, 32, replacing the grip with another grip of a desired weight and attaching the new grip to the handle via grip interfaces 22, 24 and screws 30, 32 as described above. Alternatively, handle weight may be adjusted by interchanging different weighted bars for grip bar 34 within a single grip, whereby bar 34 is removed from that grip and a weighted bar is inserted within covering 40 and attached to the handle in substantially the same manner described above. The handle may be constructed for use with set weights, varying weights or as part of a series of interchangeable handles having increasing weight.

Handle 10*a* may include other configurations for increasing the handle weight. For example, the handle may include a generally circular frame having a grip extending along a transverse diameter. The handle frame may be constructed of steel and weigh approximately two pounds, while the grip weighs approximately one pound to provide an increased handle weight. The handle frame may alternatively include a flat upper portion extending parallel to the grip. The handle includes a base to removably connect a band to the handle and facilitate band interchange as described above, and further accommodates interchange of variable weighted grips as described above to provide for adjustment of exercise device resistance based on band tensile strength and/or handle weight.

Figure 8:
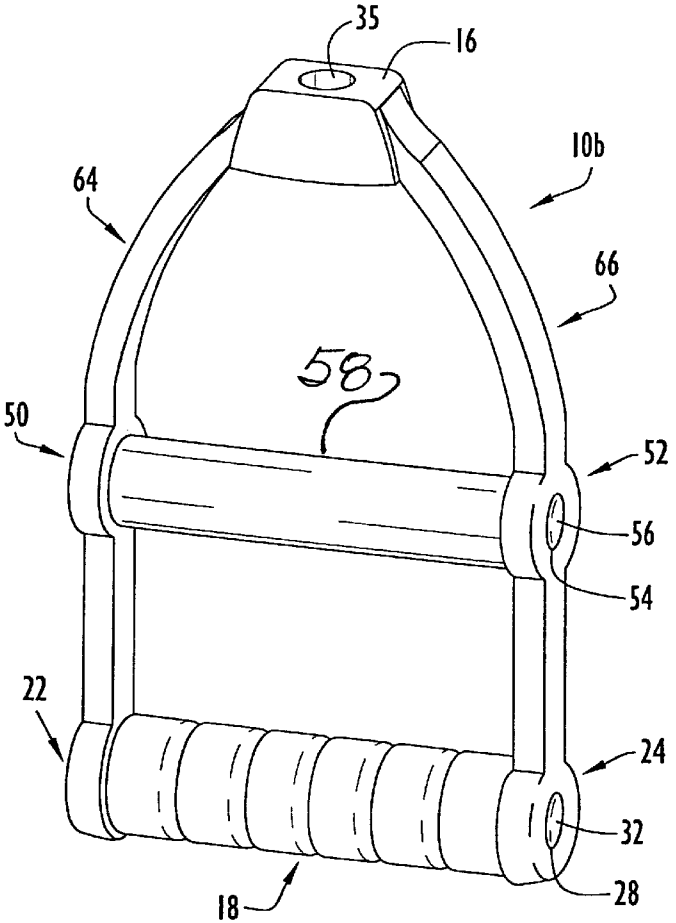
FIG. 8 is a view in perspective of a modified handle according to the present invention.

An alternative embodiment of handle 10*a* for accommodating multiple weights is illustrated in FIG. 8. Handle 10*b* is substantially similar to handle 10*a* described above except that handle 10*b* includes an additional weighted bar to increase handle weight. Specifically, handle 10*b* includes arms 64, 66, base 16, grip 18 and a weighted bar 58. Arms 64, 66 are similar to arms 12, 14 described above for FIGS. 1–3, and are each preferably of rectangular cross-section having a tapered distal end. The arms are preferably constructed of high density plastic, but may be constructed of any suitable materials. Arm 66 includes grip interface 24 disposed at the arm proximal end having a generally annular configuration with a substantially central recessed opening 28 for receiving screw 32 to secure grip 18 to the handle as described above. Arm 66 further includes a weighted bar interface 52 disposed distally of grip interface 24 at an intermediate portion of the arm. Weighted bar interface 52 is substantially similar to grip interface 24 and includes a generally annular configuration with a substantially central recessed opening 54 for receiving a screw 56 to secure weighted bar 58 to the handle as described below. Arm 66 includes a slight bend disposed distally of weighted bar interface 52 and curves inwardly from the bend toward a handle interior.

Arm 64 is substantially similar to arm 66 and includes grip interface 22 disposed at its proximal end having a generally annular configuration with a substantially central recessed opening (not shown) for receiving a screw (not shown) to secure grip 18 to the handle as described above. Arm 64 further includes a weighted bar interface 50 disposed distally of grip interface 22 at an intermediate portion of the arm. Weighted bar interface 50 is substantially similar to weighted bar interface 52 and includes a generally annular configuration with a substantially central recessed opening (not shown) for receiving a screw (not shown) to secure the weighted bar to the handle as described above. Arm 64 includes a slight bend disposed distally of weighted bar interface 50 and curves inwardly from the bend toward the handle interior. Arms 64, 66 are arranged in facing relation with grip interfaces 22, 24 and weighted bar interfaces 50, 52 substantially aligned. The arms curve inwardly from their respective bends toward the handle interior with the tapered distal ends of the arms connected to base 16.

Base 16 is substantially similar to the base described above and includes a substantially central throat 35 defined therein. Throat 35 may be substantially similar to the throats described above to removably connect an elastomeric band to the handle via any of the above-described techniques. Grip 18 is substantially similar to the grip described above and is disposed between and secured to the arm proximal ends via grip interfaces 22, 24 and the corresponding screws as described above. The grip interface openings are recessed to essentially form respective notches within the arms for enabling heads of the corresponding screws to be substantially flush with the exterior surfaces of the arms when securing the grip to the handle as described above. The grip typically weighs approximately one pound, but may be interchanged with other grips of different weights in substantially the same manner described above.

Weighted bar 58 is typically in the form of a cylindrical bar and is constructed of a known weight, approximately one pound. Weighted bar 58 is substantially similar to grip bar 34 described above, whereby the weighted bar includes tapped holes (not shown) recessed centrally and axially of its opposite ends to receive screws for engagement with weighted bar interfaces 50, 52. The weighted bar interface openings are recessed to essentially form respective notches within the arms for enabling heads of the corresponding screws to be substantially flush with the exterior surfaces of the arms when securing the weighted grip bar to the handle as described above. Weighted bar 58 may be interchanged with other weighted bars of varying weight by removing the corresponding screws, replacing weighted grip bar 58 with another weighted grip bar of a desired weight and attaching the new weighted grip bar to the handle via weighted grip bar interfaces 50, 52 and the corresponding screws as described above. The grip and/or weighted bar may be replaced with grips and/or weighted bars of varying weight in any fashion or combination such that handle 10*b* may receive various weighted bars and grips to obtain a desired weight for exercise.

Figure 9:
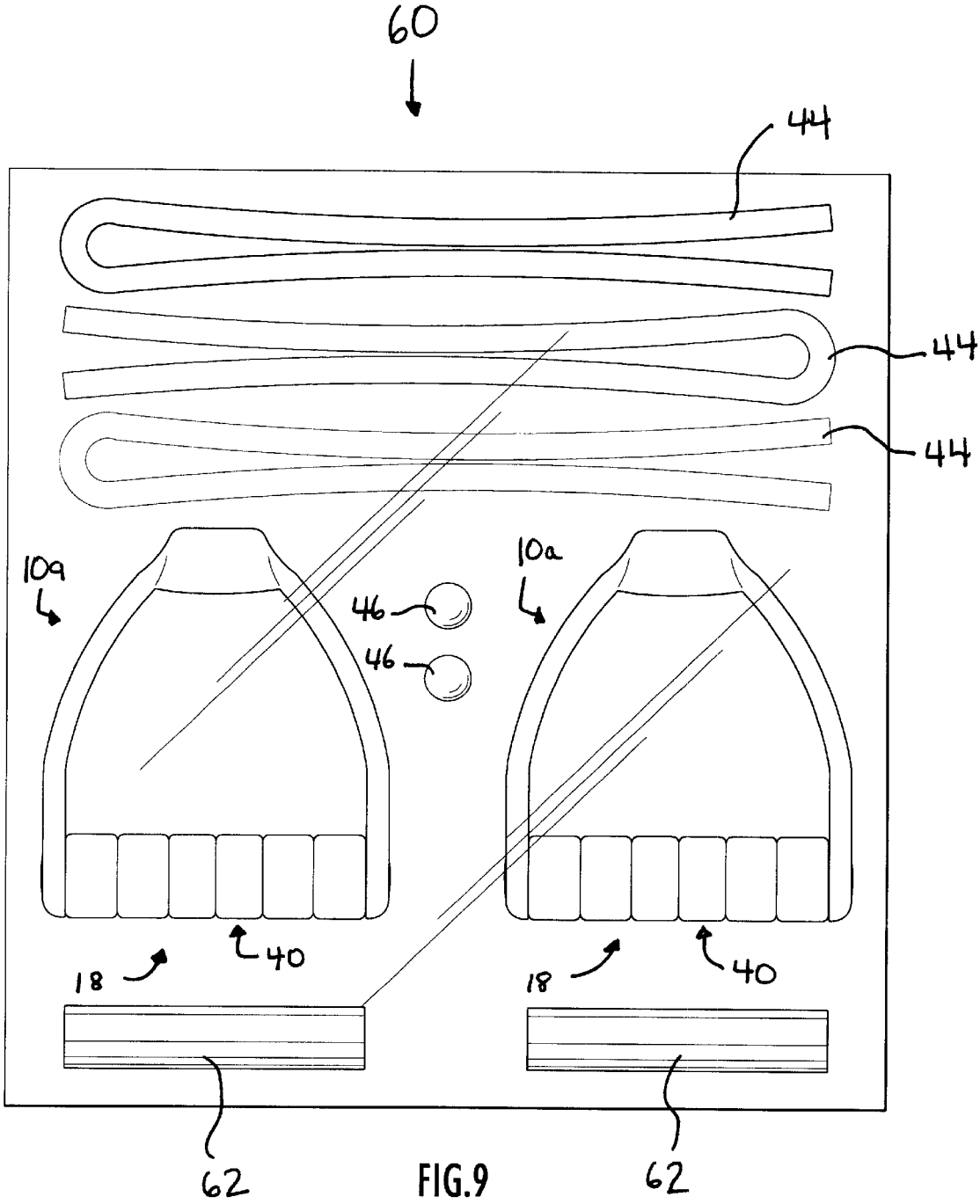
FIG. 9 is a plan view of a kit comprising exercise device components according to the present invention.

The exercise device components (e.g., the handle, band, weighted grips, etc.) may be available individually, or packaged as a kit as illustrated in FIG. 9. Specifically, exercise kit 60 includes a pair of handles 10*a*, a plurality of bands 44 each having a different tensile strength and/or diameter, a pair of retainer balls 46 each for removably connecting a corresponding band end to an associated handle and an additional weighted grip bar 62 for each handle. Bands 44 preferably provide medium, heavy and extra heavy tensions, respectively, to enable a user to select a desired resistance during exercise. The bands may further be individually packaged based on their tensile strength (e.g., individual bands may be separately available providing medium, heavy and extra heavy strengths or resistances). Weighted grip bars 62 are substantially similar to grip bars 34 described above, and provide a different weight for handles 10*a* for exercise. The weighted grip bars may be interchanged with grip bars 34 in substantially the same manner described above for interchanging grips to enable a user to exercise with a desired weight or resistance. By way of example only, the kit provides weighted grip bars 62 without cushioned covering 40. However, the weighted grip bars may include covering 40 within the kit, whereby the weighted bars may be directly interchanged with grip 18 without transferring the covering as described above.

Handles 10*a* are preferably interconnected by a band 44, whereby each end of the band is secured to a corresponding handle via retainer ball 46 as described above. The handles each typically weigh approximately one pound, providing an exercise device weight of approximately two pounds. However, other handles having different configurations and/or weight as described above may be packaged within the kit. The kit may include any quantity of each component or any quantity of total components, and may include any types of handles, bands and/or securing mechanisms described above.

Utilization of the kit to provide exercise for a user is described. Initially, the user selects a band 44 to provide a particular resistance for the exercise device. The appropriate components are removed from the kit, and the ends of the selected band are removably connected to corresponding handles 10*a* via retainer balls 46 as described above. Once the band is connected to the handles, the device may be utilized by grasping the handles by the grips in a manner such that the band is alternately stretched and released between the handles, permitting the band tension to exercise the muscles of the user. In order to adjust the exercise device resistance, the selected band may be interchanged with another band from the kit having a different tensile strength, and/or at least one handle 10*a* may be modified to utilize an additional weighted grip bar 62 from the kit as described above.

The kit or exercise device of the present invention may be utilized with various pulley exercise systems, such as over the door pulley systems, top and bottom pulley systems (e.g. mobile or stationary pulley systems on machines (e.g., swivel and slotted swivel) and wall installations (e.g., duplex pulley, chest pulley and triplex pulley weights)) or other pulley systems utilizing cable cords. The exercise device may further be utilized with various exercise equipment having various attachments, such as treadmills with pulley attachments, steppers with pulley attachments, weighted plates with pulley attachments, cross-country ski equipment with pulleys and various bands, swim trainers (e.g., land use machines) with handle attachment and rowing machines with handle attachments. Moreover, the exercise device may be attached to an axial resistance shoulder wheel using rope, cords or other bands, or be used with overhead systems that use removable weight discs or slabs and include handles. The kit or exercise device basically operatively connects to these systems in a similar manner as the system handle or other attachments. In addition, the exercise device may utilize bands of various tensions, flat resistance bands of various tensions that can be attached to the handle and/or steel cables of various gauges.

It will be appreciated that the embodiments described above and illustrated in the drawings represent only a few of the many ways of implementing an exercise device and kit.

The handle may be of any shape or size, may be constructed of any suitable materials and may be constructed to be of any desired weight. The handle components may be arranged in any fashion. The handle arms may be constructed of any suitable materials, may include any cross-sectional shape and each may include the grip interface disposed at any suitable location along the arm. The arms may include any suitable configuration, may be connected to any portion of the base via any conventional or other connection techniques and may each include a bend at any desired angle and at any suitable location along the arm. The modified handle may be of any shape or size, may be constructed of any suitable materials and may be constructed to be of any desired weight. The modified handle components may be arranged in any fashion. The modified handle arms may be constructed of any suitable materials, may include any cross-sectional shape and may include the grip and weighted bar interfaces disposed at any suitable locations along the arms. The modified handle arms may include any suitable configuration, may be connected to any portion of the base via any conventional or other connection techniques and each may include a bend at any desired angle and at any suitable location along the arm. The modified handle may further be configured to include any quantity of additional weighted bars.

The grip and weighted bar interfaces may each include any type of configuration having an opening of any shape or size defined at any suitable location on that interface. The grip and weighted bar interface openings may be recessed in any fashion, or non-recessed for respectively securing the grip and weighted bar to the handle. The grip and weighted bars may be secured to the handle via screws, bolts or any other fastener or fastening techniques. The grip and/or weighted bar may be disposed at any location on the respective handles enabling the user to grip the handle for exercise.

The grip may be utilized with or without the covering, while the covering may include any configuration, may cover any portion of the grip, may be attached to the grip via any conventional or other techniques and may be constructed of any suitable materials. The covering may include any configuration to aid gripping, such as ribbed, flat, course, etc. The grip may be of any shape or size, may be constructed of any suitable materials and may be secured to the handle via any conventional or other fastening techniques. The grip, weighted and additional bars may be of any shape, size or weight, may be constructed of any suitable materials, and may be secured to the handles or interchanged via any conventional or other securing techniques.

The base of the handle embodiments may be of any shape or size and may be constructed of any suitable materials. The base throat may be of any size, may include any configuration or shape and may be defined through any portion of the base. The throat receptacles may be of any shape or size and may be disposed at any location along the throat. The retainer ball may be solid or hollow, may be of any shape or size for cooperation with the throat, and may be constructed of any suitable materials. Alternatively, any object of suitable shape or dimensions preventing the band from traversing any of the throat configurations may be utilized by the exercise device. The retainer ball may be disposed within the tube or band at any suitable location to secure the band to the handle, to adjust resistance of the band (e.g., generally, the further the ball is inserted into the band the greater the exercise device resistance) and to prolong band life by compressing different portions of the band.

The tubes or bands may be of any shape or cross-sectional configuration, may have any length or cross-sectional dimensions, and may have any desired tensile strength or resistance. The tubes or bands may further be constructed of any resilient type or elastomeric materials. The tubes or bands may be removably connected to the handles and/or interchanged via any conventional or other securing techniques, while the handles may be configured to accommodate any quantity of tubes or bands.

The collar and ring may be of any shape or size, and may be constructed of any suitable materials. The collar or ring may alternatively be disposed proximate the throat proximal end and have dimensions greater than the dimensions of the throat proximal end to prevent the retainer ball and surrounding band portion from entering and traversing the throat, thereby securing the band to the handle.

The adjustable screw may be of any shape or size and may be constructed of any suitable materials. The passage defined by the screw body and ball-shaped head may be of any shape or size and may be defined through any portion of the screw body or head. The screw may be locked via any conventional or other type of locking device, such as a locknut, set screw, etc. The clip may be implemented by any type of fastener or clip of any shape or size, whereby the band may be clipped to any portion of the screw via any conventional or other fastening techniques.

The cord lock may be implemented by any conventional cord lock or other device attaching itself to the band, may be of any size or shape, and may be constructed of any suitable materials. The cord lock may alternatively include dimensions less than the throat proximal end dimensions but greater than the throat distal end dimensions to reside within the throat and prevent the band from becoming disengaged from the handle in substantially the same manner described above.

The hollow tube and ball may be of any size or shape and may be constructed of any suitable materials. The passage through the hollow tube and ball may be of any shape or size and may be defined through any portion of the hollow tube or ball. The hollow tube may be secured in the throat via any conventional or other type of fastener (e.g., threaded nut, clip, etc.) or fastening technique. The clip may be implemented by any type of fastener or clip of any shape or size, whereby the band may be clipped to any portion of the ball and/or hollow tube via any conventional or other fastening techniques.

The kit may include any quantity of any particular exercise device component (e.g., handle, retainer ball, tube, grip, weighted bar, etc.) or any quantity of total exercise device components. The handles within the kit may include any type of configuration, while the kit tubes or bands may be of any shape, size and/or tensile strength or resistance. The additional weighted bars may have any desired weight. The exercise device components may be available individually or in any combination. The kit is not limited to the components described above, but may include any exercise device components or any combination of exercise device components, and may further include any additional components for the exercise device itself (e.g., the alternative components for securing the tube or band to the handle) or to enable the exercise device to operatively interconnect with another exercise system.

The exercise device or kit may be operatively connected to any type of exercise or other system employing handles or other gripping attachments. The exercise device may be attached to these systems in substantially the same manner as those attachments to replace or work in combination with the attachments for enhanced exercise.

It is to be understood that the exercise device of the present invention may include handles and associated connecting structures of any type and/or configuration facilitating interchange of bands or tubes between the handles and/or interchange of weighted components of any weight, shape or size to adjust exercise device resistance.

The illustrations and descriptions herein of the exercise device handles and other components of the present invention with reference to particular orientations are for illustrative purposes only, and do not limit the present invention to any specific configuration or orientation.

From the foregoing description, it will be appreciated that the invention makes available a novel exercise device and kit wherein the exercise device and kit provide handles and associated connecting structures for facilitating interchange of elastomeric tubes and/or handle weights to adjust exercise device resistance.

Having described preferred embodiments of a new and improved exercise device and kit, it is believed that other modifications, variations and changes will be suggested to those skilled in the art in view of the teachings set forth herein. It is therefore to be understood that all such variations, modifications and changes are believed to fall within the scope of the invention as defined by the appended claims.

What is claimed is:

1. An exercise device of the type in which an elastic band is removably secured at its ends to respective handles, the handles being adapted to be held in respective hands of a user of said device when exercising, said device comprising:

in each handle:

a retaining channel for receiving an end of said band; and a generally cylindrical grip configured to be removably attached to said handle and adapted to be held in the closed hand of the user of said device, said grip having a weight of at least one pound; and wherein said grip comprises a replaceable weight disposed in a hollow cylindrical tube: and retention means securing respective ends of said band in said retaining channel of each handle.

2. The exercise device of claim 1 wherein said band is a hollow tube of resilient material and predetermined inside and outside diameters when in a relaxed, diametrically unstretched state, and wherein said retention means comprises:

a channel defined in each handle for receiving a respective end of said tube extending through the channel, said channel having a proximal end disposed proximate said grip and a distal end disposed remote from said grip, said channel having a defining wall with a transverse cross-section at least slightly larger than the predetermined outside diameter of said tube;

a stop member of larger transverse dimension than said both the transverse cross-section of said channel-defining wall and said predetermined inside diameter of said tube, said stop member adapted for insertion into a proximal portion of the tube projecting proximally from said channel such that the stop member transversely resiliently stretches the outside diameter of said tube to a dimension larger than the cross-section of said channel-defining wall and said tube resiliently conforms to and engages said stop member.

3. The exercise device of claim 2:

wherein said channel-defining wall has a generally frusto-conical configuration with a larger diameter at said proximal end than at said distal end;

wherein said stop member is generally spherical and the transverse dimension of said stop member is a diameter; and wherein a transverse portion of said stop member is smaller than the diameter of said channel-defining wall to permit a portion of the tube conforming to said stop member to enter said channel at said proximal end.

4. The exercise device of claim 3 wherein said grip hollow cylindrical tube of said grip is a cushioned cover.

5. The exercise device of claim 4 wherein said cover is plastic foam and has a series of generally circumferential ribs defined therein to facilitate gripping by the hand of a user of the device.

6. The exercise device of claim 5 wherein said grip has an axial length of approximately twelve centimeters, and a diameter including the finger grip of approximately 3.4 centimeters.

7. The exercise device of claim 1 wherein said weight comprises a weighted cylindrical member circumferentially surrounded by said hollow cylindrical tube, and wherein said hollow cylindrical tube is a cylindrical cushioned cover.

8. The exercise device of claim 7 wherein said cover is plastic foam and has a series of generally circumferential ribs defined therein to facilitate gripping by the hand of a user of the device.

9. The exercise device of claim 8 wherein said grip has an axial length of approximately twelve centimeters, and a diameter including the finger grip of approximately 3.4 centimeters.

10. An exercise device kit sold as a unit comprising:

at least one tubular resilient band capable of being resiliently stretched axially in response to axially directed forces applied thereto;

a plurality of handles, each handle including:

a retaining channel for receiving an end of said band; and a generally cylindrical grip configured to be removably attached to said handle and adapted to be held in the closed hand of the user of said device, said grip having a replaceable weight of at least one pound disposed in a hollow cylindrical member; and retention means adapted for insertion into said tubular band for securing respective ends of said band in said retaining channel of each handle.

11. The exercise device kit of claim 10 further comprising a second tubular resilient band capable of being resiliently stretched axially in response to axially directed forces applied thereto and to be used interchangeably with said at least one tubular band, said second tubular band having a different resistance to axial stretching than said at least one tubular band.

12. The exercise device kit of claim 10 wherein said weight comprises a weighted cylindrical member and said hollow cylindrical member is a cylindrical cushioned cover; and wherein said cover is plastic foam and has a series of generally circumferential ribs defined therein to facilitate gripping by the hand of a user of the device.

13. The exercise device kit of claim 12 wherein each grip has an axial length of approximately twelve centimeters, and a diameter including the finger grip of approximately 3.4 centimeters.

14. The exercise device kit of claim 12 wherein said weighted cylindrical member is a replaceable weight, and further comprising a plurality of said replaceable weights each weighing a different amount.

15. A method of assembling an exercise device comprising the steps of:

(a) connecting an axially resiliently stretchable tube to each of two handles by inserting respective ends of the tube through a distally tapered throat defined in each handle, and inserting respective stop members into the tube at each tube end to prevent removal of the tube from each handle throat;

(b) weighting each handle to a total weight of at least one pound by removably attaching a weighted member as a part of a cylindrical grip to each handle; and (c) covering the grip of each handle with a cylindrical cushion.

16. The method of claim 15 wherein said tube is diametrically resiliently stretchable and has predetermined inside and outside diameters when in a relaxed, diametrically unstretched state, wherein each stop member is ball-shaped having a diameter larger than at least a portion of said throat, and wherein step (a) includes the steps of:

projecting each end of said tube through a proximal end of a throat in a respective handle;

at each proximally projecting end of the tube, inserting one of said ball-shaped stop members into the tube by resiliently stretching the tube diametrically such that the tube substantially envelopes the ball-shaped stop member; and at each handle, distally pulling said tube such that a portion of the tube enveloping the ball-shaped stop member resides within a proximal section of the throat to engage the tube in the throat.

17. An exercise device comprising:

an interchangeable generally tubular resilient band of predetermined transverse cross-section providing a particular resistance for exercising muscles of a user; and a plurality of handles and corresponding connecting structures for removably connecting each end of said band to a corresponding handle, wherein each said handle and corresponding connecting structure includes:

a base having a distally tapered channel defined therein for receiving a corresponding band end, wherein a transverse cross-section of the channel distal portion is at least as large as said predetermined cross-section of said band and less than a transverse cross-section of the channel proximal portion;

a plurality of arms, each arm having a distal portion joined to said base;

a hand grip weighing at least one pound configured to be removably attached to said handle and extending between said arms for facilitating manipulation of that handle by said user said grip comprising a replaceable weight disposed in a hollow cylindrical tube; and a stop member substantially enveloped resiliently within said corresponding band end and including a proximal section, a distal section and an intermediate section disposed between said proximal and distal sections, wherein a transverse cross-section of said intermediate section is greater than said transverse cross-sections of said band, said proximal and distal sections and said channel distal portion and less than said transverse cross-section of said channel proximal portion, wherein said stop member intermediate section is configured to abut the channel interior and compress band portions surrounding said stop member intermediate section against walls of said channel in response to said band being pulled distally through said channel, thereby removably securing the band to that handle.

18. The device of claim 17 wherein said channel of each said handle and corresponding connecting structure is generally frusto-conical.

19. The device of claim 17 wherein said stop member and channel are configured to removably secure said band end to said handle and facilitate replacement of said band with a second band having a different tensile strength.

20. The device of claim 17 wherein said replaceable weight comprises:

a grip bar extending between said arms and weighing at least one pound; and said hollow cylindrical tube comprises a foam covering disposed over and enclosing said grip bar to facilitate gripping of said handle during exercise.

21. The device of claim 20 wherein at least one handle and corresponding connecting structure further includes a grip bar interchange mechanism to removably connect said grip bar to said arms and facilitate replacement of said grip bar with a second grip bar having a different weight to adjust exercise device resistance.

22. In an exercise device including an interchangeable resilient band to provide resistance for exercising muscles of a user, a method of adjusting exercise device resistance, wherein an exercise device handle includes a base having a channel defined therein, arms having their distal portions joined to said base and a grip weighing at least one pound disposed in a hollow cylindrical cushion tube and removably connected to said handle between said arms for facilitating manipulation of the handle by the user, said method comprising the step of:

(a) removing said grip from said handle and removably connecting to said handle a second grip having a weight greater than one pound to adjust exercise device resistance.

23. In an exercise device employing a generally tubular resilient band of predetermined transverse cross-section to provide resistance for exercising muscles of a user, a handle and corresponding connecting structure for removably connecting an end of said band to said handle comprising:

a base having a channel defined therein for receiving said band end, wherein a transverse cross-section of the channel distal portion is at least as large as said predetermined cross-section of said band and less than a transverse cross-section of the channel proximal portion;

a plurality of arms with each arm having a distal portion joined to said base;

a hand grip weighing at least one pound configured to removably attached to said handle and extending between said arms for facilitating manipulation of said handle by said user said grip comprising a replaceable weight disposed in a cylindrical cushioned tube; and a ball resiliently inserted within said band end and including a first ball section for placement externally of said channel and a second ball section for placement within said channel, wherein said second ball section includes a transverse cross-section greater than said transverse cross-sections of said band and said channel distal portion and less than said transverse cross-section of said channel proximal portion to abut proximal portions of channel walls and compress band portions surrounding said second ball section against said walls in response to said band being pulled distally through said channel, thereby removably securing the band to the handle.

24. In an exercise device including a generally tubular resilient band of predetermined cross-section to provide resistance for exercising muscles of a user, a method of removably connecting an end of said band to an exercise device handle, wherein said handle includes a base having a channel defined therein, arms having their distal portions joined to said base and a weighted grip removably attached to said handle and disposed in a hollow cylindrical tube for weighing at least one pound and facilitating manipulation of the handle by the user, said method comprising the steps of:

(a) inserting the band end proximally through the channel, wherein channel wall proximal portions are smooth and include rounded proximal channel edges and a transverse cross-section of the channel distal portion is at least as large as said predetermined cross-section of said band and less than a transverse cross-section of the channel proximal portion;

(b) resiliently inserting a stop member within said band end, wherein said stop member includes a proximal section for placement externally of said channel and a distal section having a transverse cross-section greater than said transverse cross-sections of said band and said channel distal portion;

(c) pulling said band distally through said channel such that said stop member distal section abuts channel wall proximal portions;

(d) compressing band portions surrounding said stop member distal section against said smooth and rounded channel wall proximal portions via said stop member distal section to removably secure the band to the handle in response to said band being pulled distally through said channel; and (e) reducing band wear during said compression by arranging said smooth and rounded channel wall proximal portions to provide a smooth surface with rounded proximal channel edges against which said surrounding band portions are compressed by said stop member.

25. The method of claim 24 wherein said stop member includes a ball, and step (b) further includes:

(b.1) resiliently inserting said ball within said band end, wherein said ball includes a diameter greater than said transverse cross-sections of said band and said channel distal portion;

step (c) further includes:

(c.1) pulling said band distally through said channel such that said ball abuts channel wall proximal portions;

step (d) further includes:

(d.1) compressing band portions surrounding said ball against said smooth and rounded channel wall proximal portions via said ball to removably secure the band to the handle in response to said band being pulled distally through said channel; and step (e) further includes:

(e.1) reducing band wear during said compression by arranging said smooth and rounded channel wall proximal portions to provide a smooth surface with rounded proximal channel edges against which said surrounding band portions are compressed by said ball.

* * * * *